United States Patent [19]

Kvarnäng

[11] Patent Number: 4,540,031

[45] Date of Patent: Sep. 10, 1985

[54] MACHINE FOR REMOVING MATERIAL FROM LOGS

[76] Inventor: Roger Kvarnäng, Nordanågatan 18, S-820 10 Arbrå, Sweden

[21] Appl. No.: 589,092

[22] PCT Filed: Jun. 23, 1983

[86] PCT No.: PCT/SE83/00260

§ 371 Date: Feb. 13, 1984

§ 102(e) Date: Feb. 13, 1984

[87] PCT Pub. No.: WO84/00127

PCT Pub. Date: Jan. 19, 1984

[30] Foreign Application Priority Data

Jun. 24, 1982 [SE] Sweden ..... 8203956

[51] Int. Cl.[3] ..... B27C 1/00; B27L 11/00

[52] U.S. Cl. ..... 144/2 R; 144/162 R; 144/208 G; 144/377; 409/166

[58] Field of Search ..... 144/2 R, 3 R, 4, 162 R, 144/208 R, 208 G, 208 J, 208 F, 377; 409/166, 192, 197, 199, 200, 203

[56] References Cited

U.S. PATENT DOCUMENTS 4,363,342 12/1982 Tannerstal ..... 144/2 R

*Primary Examiner*—W. D. Bray

*Attorney, Agent, or Firm*—Zarley, McKee, Thomte, Voorhees & Sease

[57] ABSTRACT

A machine for removing root swellings on tree logs comprises a holding device (2) for supporting the log generally from below with an end portion (4) thereof protruding freely from the holding device. Furthermore, the holding device is adapted to cause the log to rotate. A rotatable milling unit (5) has peripherically or externally located processing elements and is located for processing the protruding end portion of the log from below. The holding device has bearing members (6, 6*a*) operable for moving the log between an upper position and a lower position. The bearing members are located in such a way relative to the milling unit that a log resting on the bearing members on lowering thereof will enter into contact with the milling unit, which is stationarily mounted to a frame of the machine.

8 Claims, 3 Drawing Figures

MACHINE FOR REMOVING MATERIAL FROM LOGS

FIELD OF INVENTION AND PRIOR ART

The present invention is related to a machine for removing material from logs, in particular root logs having swellings to be removed.

Such a machine is disclosed in the applicants Swedish patent application No. 7712493-1. The arrangement of the milling unit for processing the end portion of the log freely protruding from the holding device from below has the advantages that the milling of the root swellings can occur while maintaining the general main shape of the log at the same time as it will be easy to avoid, by means of suitable shield and protection devices, millings to be thrown about without having to reduce the possibility of the operator to visually supervise the processing procedure.

The machine according to the previous patent application is constructed so that the logs are fed sidewardly into the machine. In certain cases, it may be desirable to have also other possibilities for introducing logs into the machine. Furthermore, the milling unit is in this machine movably arranged, which makes the structure somewhat complicated. Thus, it would be desirable to be able to devise ways to achieve a more simple and more non-expensive embodiment.

SHORT DISCLOSURE OF THE INVENTION

The object of the present invention is to devise ways for satisfying the desires presented hereinabove within the scope of the protection defined by the previous patent application.

In accordance with the present invention, this object is obtained by the features contained in the characterizing portion of claim 1. The design of the holding device as including elevatable bearing members makes it possible to feed the logs into the machine also in its longitudinal direction by designing these bearing members for allowing longitudinal transport of logs. Furthermore, by the location of the bearing members relative to the milling unit defined in claim 1, the combination effect is obtained that the bearing members preferably designed for longitudinal transport may be given the task to move the log into contact with the milling unit so that, accordingly, the milling unit may be mounted stationary on the frame of the machine.

SHORT DISCLOSURE OF THE DRAWINGS

With reference to the appended drawings, a more specific disclosure of an embodiment example of the invention will follow hereinafter.

DETAILED DISCLOSURE OF A PREFERRED EMBODIMENT

Figure 1:
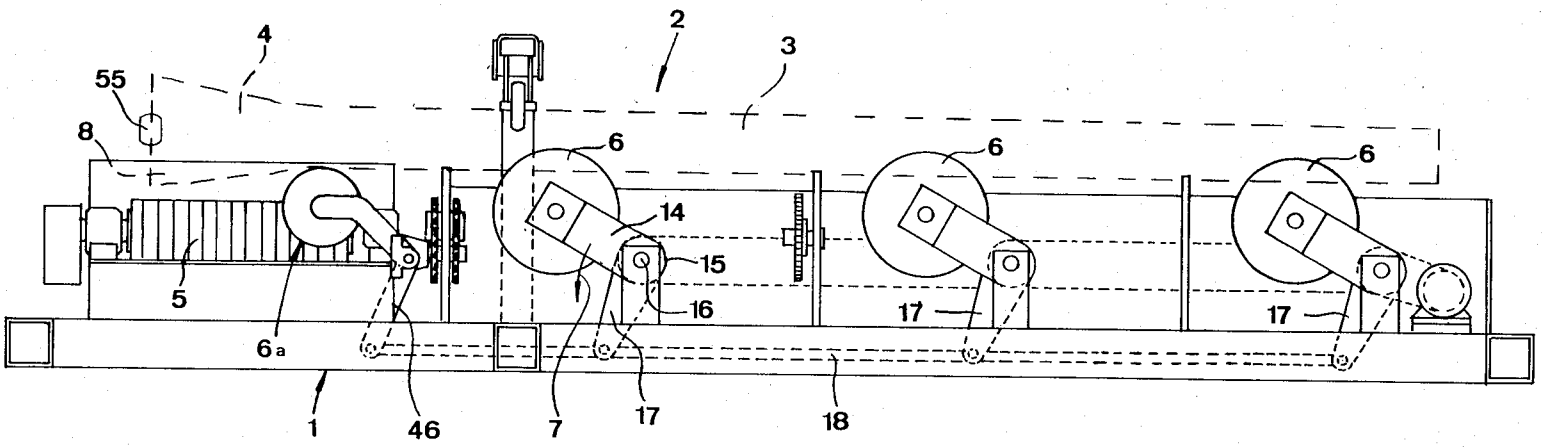
FIG. 1 is a diagrammatical side view of the machine according to the invention.

The machine illustrated in the drawings and adapted for removing material from logs, in particular root logs having swellings to be removed prior to sawing of the logs, comprises a frame denoted 1. On this frame, there is a holding device 2 for supporting the log 3 with an end portion 4 thereof protruding freely from the holding device. The holding device is also adapted to cause the log to rotate. Furthermore, the machine comprises a rotatable milling unit 5 having peripherically located processing elements and being located for processing the end portion 4 of the log protruding freely from the holding device 2 from below. With the expression "from below", it is understood that the milling unit during the processing should be in contact with the lower half of the log.

The holding device 2 comprises bearing members 6 operable for moving the log between an upper position (FIG. 1 and 3) and a lower position, which is reached by moving the bearing members downwardly in the direction of arrow 7 in FIG. 1. The bearing members 6 are located in such a way relative to the milling unit 5 that a log having root swellings 8 or the like and located on the bearing members on lowering thereof in a direction towards their lower position enters into contact with the rotating milling unit.

The milling unit 5 is stationarily mounted to the frame 1 of the machine. With the expression "stationarily" it is intended that the mounting devices of the milling unit preferably are such that no adjustment of the milling unit occurs during processing of a single log. However, this does not exclude that more permanent adjustments of the milling unit may occur. In the example, the milling unit is generally cylindrical and located with its axis of rotation extending generally parallel to the longitudinal direction of a log situated in the machine. The processing elements are arranged on the mantle surface of the milling unit. Pin shafts located at the opposite ends of the milling unit are received in bearings 9. On one of the pin shafts, there is attached a belt wheel or the like, which through a belt or other transmission member 10 cooperates with a belt wheel or the like arranged on the drive shaft of a motor 11.

Figure 3:
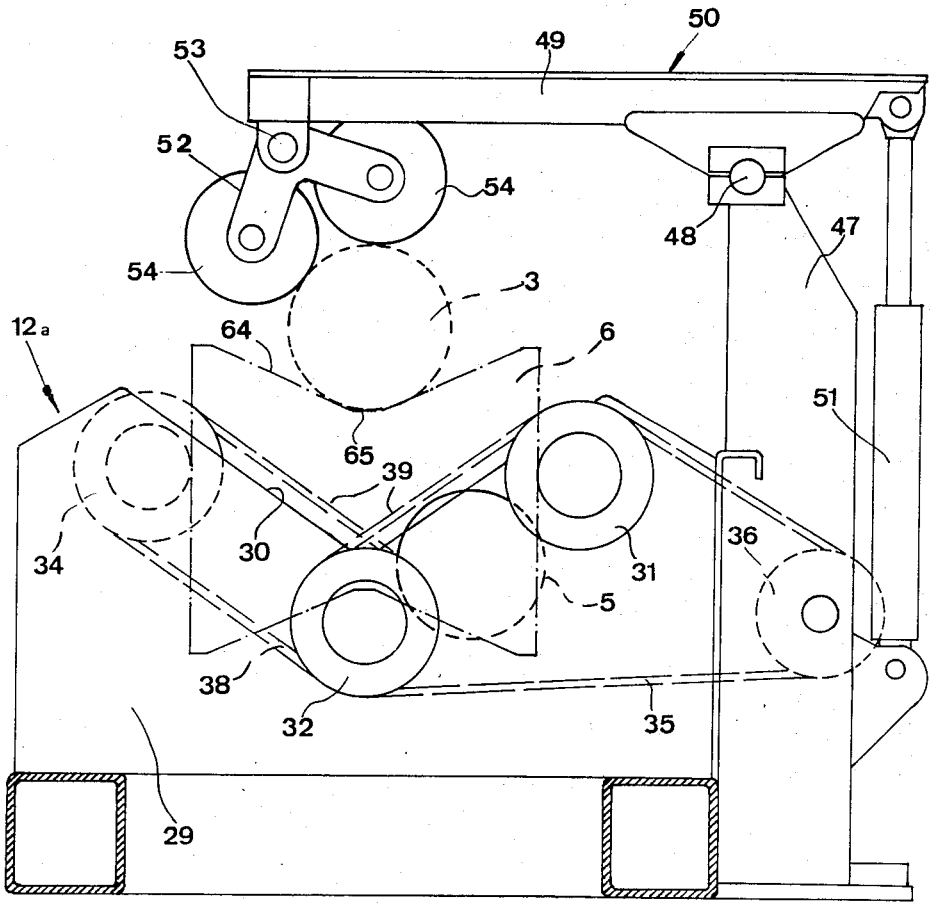
FIG. 3 is a cross section along line III—III in FIG. 2.

The bearing members 6 are adapted, in their upper position, to hold the log free from support members 12*a*, 12*b* and 12*c*, which in the lower position of the log are adapted to support the same from below. The bearing members 6 are formed by rolls, the axes 13 of rotation of which extend generally perpendicularly to the longitudinal direction of a log situated in the machine. The rolls, in this case three, have an envelope surface with an outwardly concave design so as to form, by said concavities, seats 64 for logs, the middle points of said seats being located in the vicinity of the center of the rolls. The seats 65 are preferably V-shaped. Thus, these rolls allow longitudinal movement of the log when the rolls are in their upper position (FIG. 1 and 3).

The bearing rollers 6 are held in arms 14, which are rigidly attached to a sleeve 15, which surrounds and is rotatably movable about a shaft 16 mounted on the frame 1 and generally parallell to the axes 13 of rotation of the rolls. On the sleeve 15 there is also rigidly attached a lever 17. The three levers 17 associated to the rolls 6 are interconnected by a longitudinal operating element 18 which by means of a piston cylinder mechanism 19 or the like (see FIG. 2) is movable reciprocatingly so that the rolls 6 are pivoted upwardly and downwardly (arrow 7) about pivot shafts 16.

The rolls 6 are in this case all drivable in order to obtain said longitudinal movement of the log. In order to realize this drive, chain wheels 20 are arranged on the shafts 13 of the rolls, said wheels cooperating by means of chains 21 with chain wheels 22 on the various shafts 16. The roll 6 located to the right is driven in that its chain wheel 22 is seated upon a sleeve 23 which is rotatably journalled about shaft 16 and which through a chain transmission is driven by the motor 24. On the sleeve 23, there is rigidly attached another chain wheel 25, which through a chain 26 and a chain wheel 27 puts a sleeve on the adjacent shaft 16 in rotation. The roll 6 located most closely to the milling unit is finally driven through a chain 28. Individual drive motors for each roll would also be possible.

The support members 12*a*, 12*b* and 12*c* have all a generally V-shaped log receiving configuration which opens upwardly. An example of the design of the support member 12*a* located most closely to the milling unit is illustrated more closely in FIG. 3. It includes a plate or the like 29 with a V-shaped recess 30 at the top. Four chain wheels (see also FIG. 2) 31, 32, 33 and 34 are rotatably journalled in plate 29 with their axes of rotation extending parallel to the longitudinal direction of the log in the machine. The four chain wheels form as viewed in FIG. 3 a V-shaped configuration corresponding to recess 30. A chain 35 is laid about chain wheels 31 and 32 and runs also about chain wheel 36 driven by a motor 37. Another chain 38 is laid about the two wheels 33 and 34. The chain wheels 32 and 33 are rigidly attached to the same shaft, which means that rotation of chain wheel 36 and resulting movement of chain 35 involves movement also of chain 38. The wheels 31–34 are located in such a way relative to the upper edges of recess 30 that upper parts 39 of the two chains protrude upwardly above the edges of recess 30 so that a log lowered into the support member 12*a* will be engaged by the chain parts 39 and imparted a rotation in desired direction by said chain parts.

An alternative to the use of chains 35 and 38 in the manner described with the aid of FIG. 3 would be to use two cooperating rolls having parallel axes and forming an upwardly generally V-shaped configuration.

The intermediate support member 12*b* is in this case formed by two rolls 40 located in a manner described above. The rolls 40 are journalled in a transversal plate 41 attached to frame 1. The support member 12*c* located most separated from the milling unit 5 is in this case simply formed by a plate 42 provided with an upwardly open recess for receiving the log.

It is evident that also support members 12*b* and 12*c* could be associated to means for assisting the drive of the log in its rotational movement.

As appears by FIG. 3, the central portions of the V-shaped seats in the support members 12*a*–12*c* are located opposite the seats 15 in the rolls 6 so that when the rolls are lowered to their lower positions, the envelope surfaces of the rolls will be located under the support surfaces of the support members so that the support members will take over the task of supporting the log. When the bearing rolls 6 again are lifted, the log will be lifted out of contact with the support members.

Opposite the milling unit 5, there is provided another bearing member 6*a* comprising a relatively thin roll 43 adapted to support the log at its central lower region during the longitudinal movement of the log over the milling unit 5. The roll 43 is located in the extension of the deepest regions of the envelope surfaces of rolls 6. The roll 43 is rotatably supported on an arm 44 about an axis parallel to the axes 13. The arm is rigidly attached to a sleeve 45 which is rotatably supported about a transversal shaft in the frame. On the sleeve 45, there is rigidly attached an operating arm 46, which in turn is connected to the previously mentioned operating bar 18 so that also roll 6*a* is elevated upon elevation of rolls 6 and vice versa. However, it is to be mentioned that the bearing member 6*a* could be elevatable independently from the other rolls 6.

The roll 43 of the bearing member 6*a* is circular and has its upper periphery located in the same plane as the deepest areas on the upper side of rolls 6.

A pressing device 50 is adapted to press the log downwardly against the bearing members 6, 6*a* during lowering thereof in a direction towards their lower position. The pressing device comprises a stand 47, which is attached to the frame and carries an arm 49 pivotable about a shaft 48 generally parallel to the longitudinal axis of the log by means of a power member 51. On the arm, a pressing member 52 is pivotably supported about an axis 53 generally parallel to axis 48. The pressing member 52 carries at least two rolls 54, which have their axes of rotation generally parallel to axes 48, 53 and are intended for contact with the log 3. The pressing member 52 is preferably spring loaded or in other way actuated into a balance position, preferably a position in which the axes of rotation of the rolls 54 are in a horizontal plane. The pivotability about axis 53 ensures good contact between the pressing member and the log independently of the level of the log in the machine and the diameter of the log.

Figure 2:
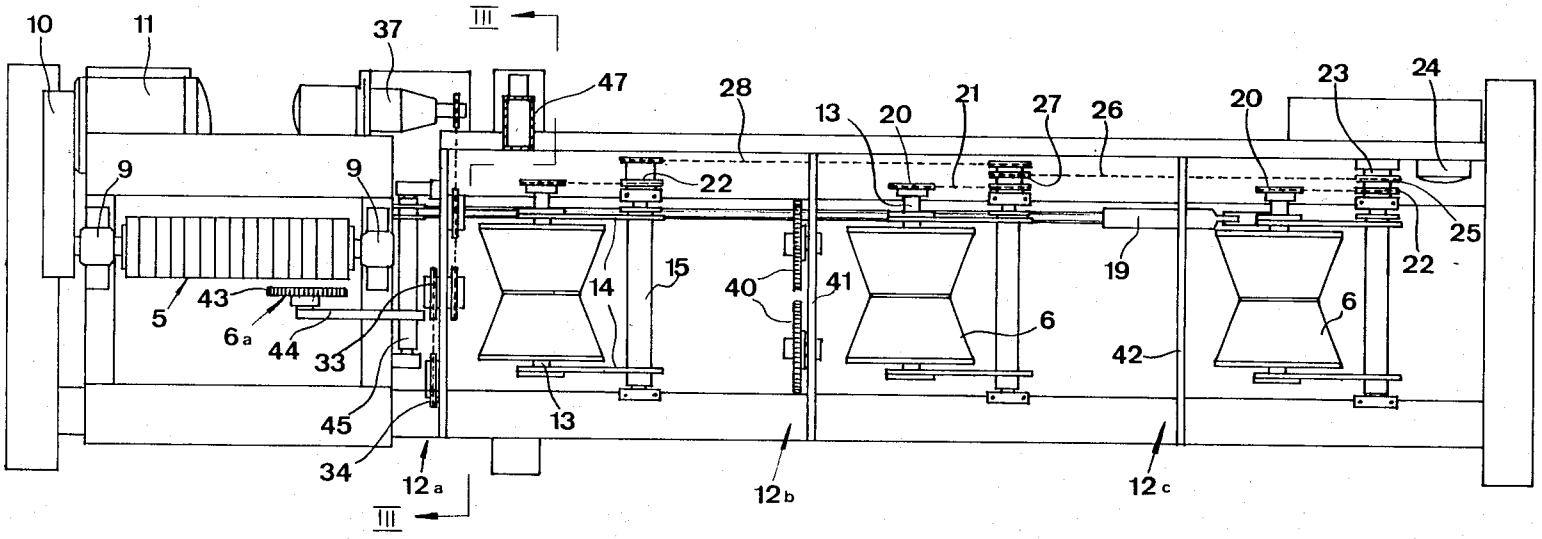
FIG. 2 is a view of the machine from above.

As appears by FIGS. 1 and 2, the pressing device 50 is located between the outermost support members 12*a* and 12*c*. It is important that the pressing device is located on the side of the support member 12*a* which is facing away from the milling unit 5 but since that support member is the only which has drive means for rotating the log, it is desirable that the pressing device is located rather close to said support member. The pressing device is also located between the outermost bearing members or rolls 6 and 6*a*. In choosing the location of the pressing device relative to the support members and bearing members, it is decisive that the log in efficient and stable manner can be pressed down against the members in question.

The machine described is used as follows: Logs to be processed in the machine arrive preferably from the left in FIGS. 1 and 2 from supply devices not illustrated and have their top end first. During introduction of a log into the machine, the bearing rolls 6 and 6*a* are lifted so that the log by means of the driven rolls 6 is moved to the right until a photocell or other sensing device 55 (FIG. 1) indicates that the root end of the log has reached a position relative to the milling unit suitable for processing, at which time the motor 24 is controlled to stop rolls 6. The intention is that the machine during normal use shall have the milling unit 5 and chains 35 and 38 continously in rotation. When the log has stopped, such control impulses are obtained by means of a control unit that power member 51 is expanded to press the log downwardly against rolls 6. At the same time, the control unit provides that the operating device for elevating the rolls 6, i.e. the cylinder 19, allows a controlled lowering of the log which it is held clamped between the pressing device 50 and rolls 6. Root swellings 8 on the log will enter into contact with the milling unit and are milled away at the portion of the log located close to the milling unit. When the log has been lowered so far that its envelope surface enters into contact with the rotating drive chains 35 and 38, the log will automatically be put into rotation while the log is carried by the support members 12*a*–12*c*. During the rotation, the milling unit 5 removes roots swellings on the log. Since the milling unit 5 is adapted to process the end portion of the log from below (the milling unit 5 may be located obliquely under the log 3 in the manner illustrated in FIG. 3) the log will be processed along a line in the extension of contact points between the envelope surface of the log and the various support members 12*a*, 12*b* and 12*c* whereby the natural conicity of the log is not changed during the milling of the root swellings.

In order to control the duration of the processing, an adjustable timer is preferably used, which is started when the photocell 55 initiates lowering of the log towards the milling unit. When the adjusted time has lapsed (the log should at that time be finally processed) the cylinder 51 is controlled to pivot arm 49 upwardly. A limit switch actuated thereby will first make the rolls 6 to pivot upwardly and then the drive of rolls 6 to be initiated so that the log will be moved out of the machine in its longitudinal direction.

Logs may of course also be introduced into the machine from its side.

I claim:

1. A machine for removing swellings from an elongated log having opposite ends, said machine comprising:

a frame;

a holding device on said frame for holding and rotating said log with one of said ends of said log protruding from said holding device, a rotatable milling unit on said frame having processing elements thereon for engaging and processing said one end of said log protruding from said holding device, said holding device including bearing members supporting said log and being movable from an upper position wherein said log is located above and free from engagement with said milling unit to a lower position wherein said log is in contact with said milling unit.

2. A machine according to claim 1 wherein said milling unit is stationarily mounted to said frame.

3. A machine according to claim 1 wherein at least one support member is mounted to said frame, said support member being positioned relative to said bearing members so as to engage and support said log when said bearing members are in said lower position and so as to be free from supporting engagement with said log when said bearing members are in said upper position.

4. A machine according to claim 3 wherein said bearing members comprise rolls for permitting longitudinal transporting of said log with respect to said bearing members when said bearing members are in said upper position.

5. A machine according to claim 1 comprising a pressing device on said frame for engaging and pressing said log downwardly against said bearing members as said bearing members move downwardly towards said lower position.

6. A machine according to claim 5 wherein said pressing device comprises an arm pivotable with respect to said frame about a first axis generally parallel to the longitudinal axis of said log, and a pressing member pivotally mounted with respect to said arm about a second axis generally parallel to said first axis.

7. A machine according to claim 6 wherein said pressing member carries at least two rotatable rolls having their axes of rotation generally parallel to said first and second axes.

8. A machine according to claims 1–7 wherein a thin bearing member is positioned adjacent said milling unit for supporting said log and permitting longitudinal transporting of said log over said milling unit.

* * * * *